US006691626B2

(12) United States Patent
Warner

(10) Patent No.: US 6,691,626 B2
(45) Date of Patent: Feb. 17, 2004

(54) ADJUSTABLE TABLE

(76) Inventor: Steve Warner, 6311 Trap Line Cir., Chanhassen, MN (US) 55317

( * ) Notice: Subject to any disclaimer, the term of this patent is extended or adjusted under 35 U.S.C. 154(b) by 0 days.

(21) Appl. No.: 10/079,200

(22) Filed: Feb. 19, 2002

(65) Prior Publication Data

US 2003/0154890 A1 Aug. 21, 2003

(51) Int. Cl.[7] ..... A47B 9/00
(52) U.S. Cl. ..... 108/145; 108/147; 248/421
(58) Field of Search ..... 108/145, 147, 108/9, 10, 146, 144.11; 248/421, 188.2, 188.4, 292.13, 585, 157

(56) References Cited

U.S. PATENT DOCUMENTS 3,302,971 A * 2/1967 Lory ..... 108/145
3,703,147 A * 11/1972 Selander ..... 108/145
3,710,735 A * 1/1973 Litvinoff et al. ..... 108/146
4,638,610 A * 1/1987 Heikkinen ..... 108/145
4,817,220 A * 4/1989 Guttormsem ..... 108/145
4,898,103 A * 2/1990 Pontoppidan et al. ..... 108/145
5,469,793 A * 11/1995 Lindsay ..... 108/2
5,694,864 A * 12/1997 Langewellpott ..... 108/145
5,823,120 A 10/1998 Holmquist
5,953,776 A * 9/1999 Sanders et al. ..... 108/145
6,038,986 A * 3/2000 Ransil et al. ..... 108/145
6,055,912 A 5/2000 Doud et al.

FOREIGN PATENT DOCUMENTS

FR 2571234 * 10/1984

* cited by examiner

*Primary Examiner*—Jose V. Chen
(74) *Attorney, Agent, or Firm*—Fulbright & Jaworski L.L.P.

(57) ABSTRACT

An improved adjustable desktop that is portable and mobile, that supports current technological needs of users (e.g., computer equipment) and that provides for different ranges of height adjustment (e.g., low-to-the-floor for children and greater spacing from the floor for adults). The desktop includes a working area with an end portion, a vertically adjustable support member pivotably coupled to the end portion and a manual actuator coupled to the vertical support. The manual actuator is disposed above both the working area and the vertically adjustable portion of said vertical support member allowing for easy adjustment of the vertical height of the work surface.

21 Claims, 3 Drawing Sheets

ADJUSTABLE TABLE

FIELD OF THE INVENTION

The present invention relates to the field of adjustable furniture. In particular, the present invention is directed to a table having a mechanism to raise and lower the desktop portion of the table as desired by a user and which mechanism automatically locks into place after the desktop is raised or lowered and which optionally supports a computer processor and may be equipped with wheels for portability of said table.

BACKGROUND OF THE PRESENT INVENTION

Adjustable furniture, including adjustable height tables, have a long history of gradual innovation and improvement. For example, U.S. Pat. No. 6,055,912 issued to Doud et al. on May 2, 2000 discloses and claims an adjustable height ready-to-assemble table having a working area disposed between two upright support members and mounting brackets which can be manually adjusted to support the working area at different heights relative to a floor. The Doud et al. patent references other patents, including U.S. Pat. No. 327,413 issued to Rohrbach in September, 1885.

Other prior art includes U.S. Pat. No. 5,823,120 issued to Holmquist on Oct. 20, 1998 in which a stationary, vertically adjustable desk includes a desktop supported above a support stand. The Holmquist patent discloses and claims a first and a second gas spring means including a handle for manual operation of the gas spring means. Each of the gas spring means includes a valve for locking and unlocking movement of fluid or gas inside the gas spring means which is attached to the handle.

A continued need in the art exists for improved adjustable height tables, in particular, such tables that are portable and mobile, that support current technological needs of users (e.g., computer equipment) and that provide for different ranges of height adjustment (e.g., low-to-the-floor for children and greater spacing from the floor for adults). In addition, such improved adjustable tables should also accommodate all variety of chairs, including wheelchairs, for users of the table. Such a table should provide an easy to reach adjustment mechanism and should impart force to assist adjustment of the elevation of the table. The imparted force should be adjustable by the user so that very heavy objects placed on the table are adequately supported. Finally, such an improved table should be compact during shipment or delivery to the user, should be easy to assemble, and readily adjustable.

SUMMARY OF THE INVENTION

The present invention addresses the continued need in the art described above. That is, the present invention teaches, describes, enables, illustrates and claims an improved adjustable height working area that is portable and mobile, that supports current technological needs of users (e.g., computer equipment) and that provides for different ranges of height adjustment (e.g., low-to-the-floor for children and greater spacing from the floor for adults). In addition, the present invention also may be configured to accommodate all variety of chairs, including wheelchairs, for users and/or operators of the improved desktop of the present invention. The present invention provides an easy to reach adjustment height mechanism that imparts force to assist adjustment of the height of the working area and the imparted force is adjustable by the user so that very heavy objects placed on the table are adequately supported during adjustment of the height of the table. Finally, the improved table of the present invention is compact during shipment and delivery to the user, and is very easy to assemble and operate.

BRIEF DESCRIPTION OF THE DRAWINGS

In this disclosure, only certain embodiments are depicted, and not all or every insubstantial change or modification of each such embodiment are depicted or described herein, although those of skill in the art to which the invention is directed will appreciate many insubstantial changes to the teaching of this disclosure that nevertheless fall within the spirit and scope of the invention. In this disclosure, reference numerals are used to refer to various elements, sub-elements and process steps and the same reference numeral is intended to denote all similar or identical elements set forth herein.

DETAILED DESCRIPTION OF THE PREFERRED EMBODIMENTS

Figure 1:
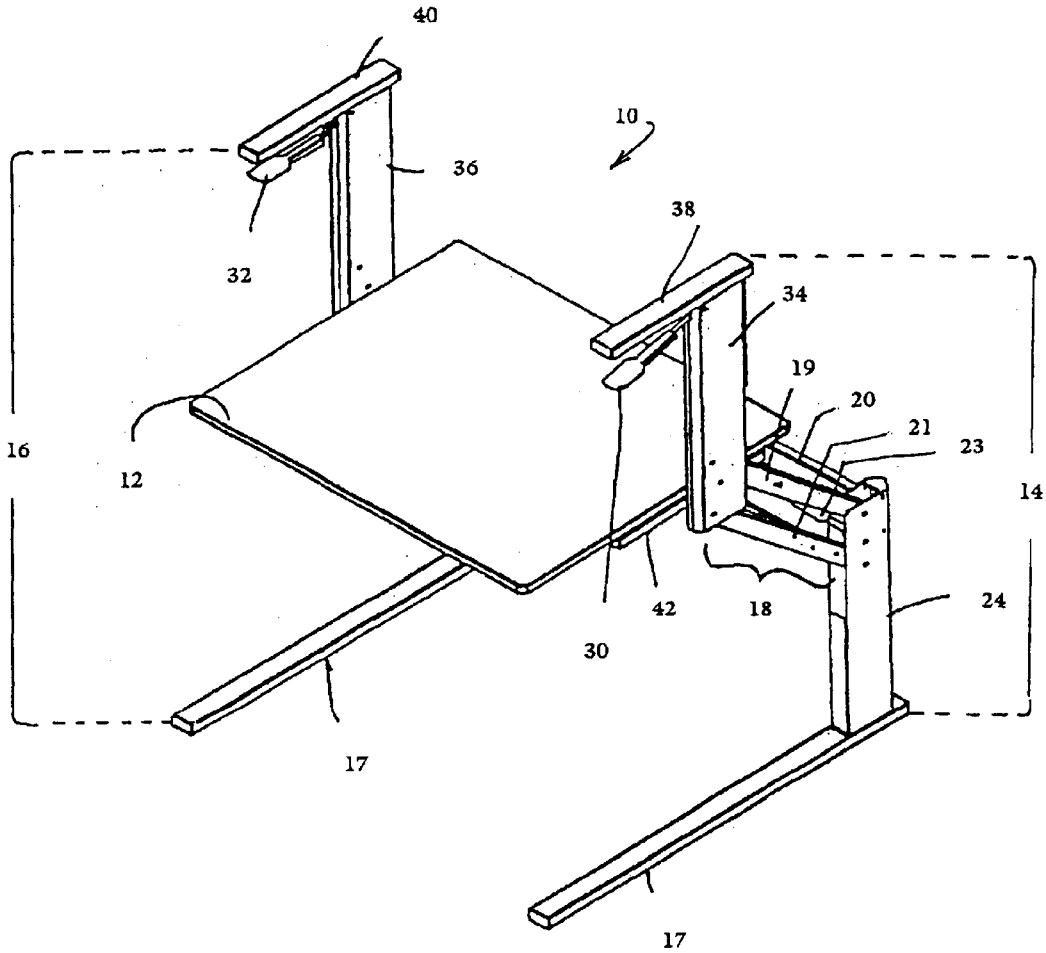
FIG. 1 is a perspective view of an embodiment of the improved desktop of the present invention depicting the working area at an upper range of vertical adjustment.

In FIG. 1 an embodiment of the improved, vertically adjustable desktop 10 of the present invention is shown having a working area 12 mounted to a first and a second vertical support 14, 16. First and second vertical supports 14, 16 comprise first and second lower static supports 24, 26 and first and second upper static supports 34, 36. Lower static supports 24, 26 are connected to upper static supports 34, 36 by an adjustable linkage 18 comprising a first arm 19 spaced apart from a second arm 21. Linkage 18 is preferably pivotably connected at one end to one of lower static supports 24, 26 and at the other end to one of upper static supports 34, 36.

Figure 2:
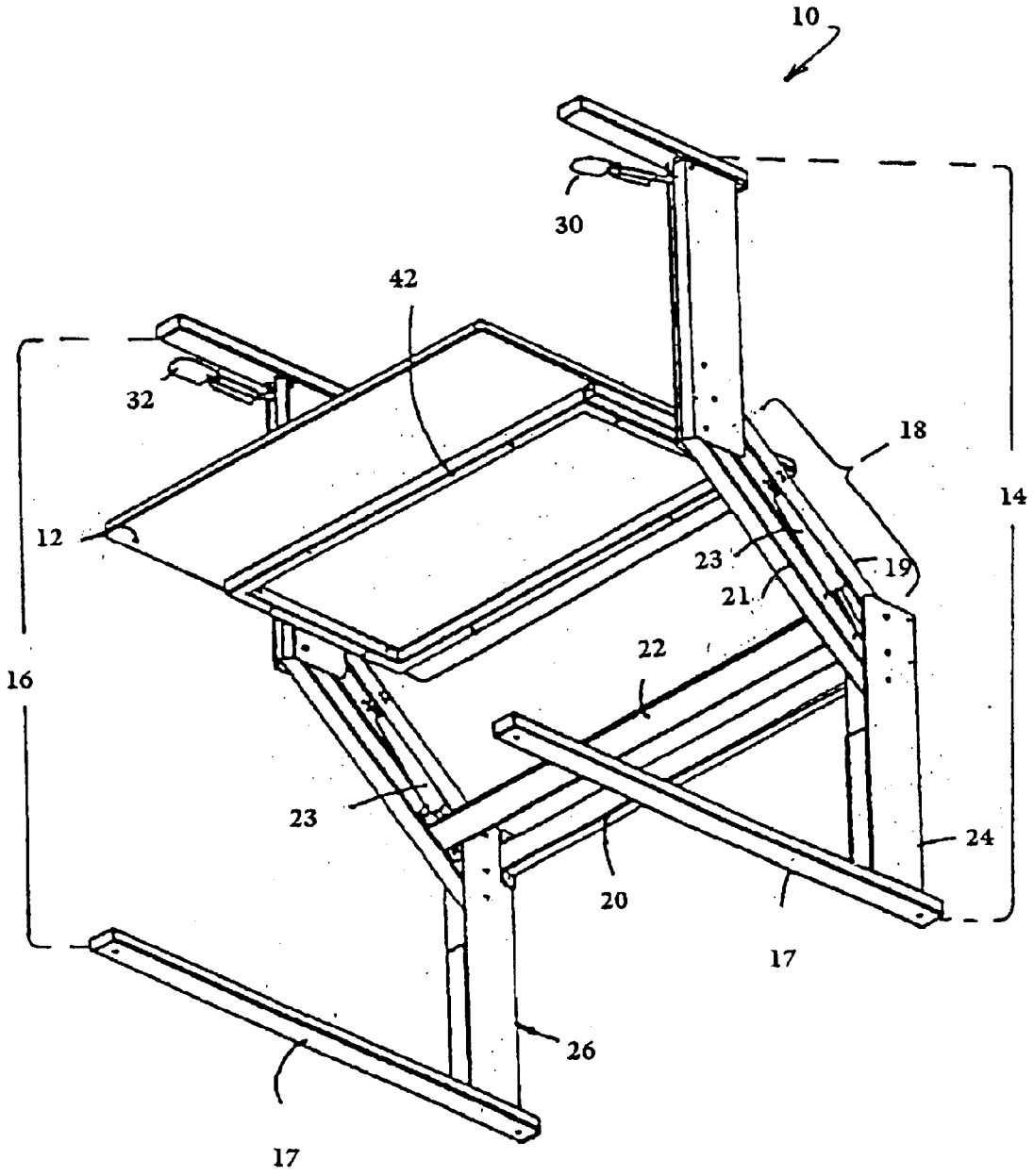
FIG. 2 is a perspective view of the embodiment depicted in FIG. 1, except as viewed from underneath the improved desktop of the present invention.

As depicted in FIG. 2, the first and second vertical support 14, 16 are preferably mechanically coupled together with a first and second brace member 20, 22 to increase rigidity of the improved desktop 10 when fully constructed. The first brace member 20 preferably couples to a first and second static lower support portion 24, 26 of the vertical supports 14, 16. The first and second static lower portions 24, 26 are preferably L-shaped with an elongate foot portion 17 extending outward to engage a floor surface to provide stability to the desktop 10. Preferably, the elongate foot portion 17 extends beyond a front and rear portion of the working area 12 to add stability, although this is not a requirement for practicing the present invention. Optionally, and while not depicted in the drawings, the elongate foot portion 17 may have caster wheels, non-slip pads and the like coupled to the foot portion 17 to provide a measure of mobility and attachment, respectively to the desktop 10. Alternatively, the foot portion 17 may be fastened to a floor surface with nails, adhesive, screws, hook and loop patches, and the like if desired for a given application and use of the desktop 10 of the present invention. While not depicted, additional support members coupled from the first to the second vertical support 14, 16 may be used to further increase the structural integrity of the assembled desktop 10 and one or more bracing members may be coupled from either vertical support 14, 16 to either the first or second brace member 20, 22. In one embodiment, a storage compartment 50 (shown in FIG. 1) is coupled to the elongate foot portion 17 and configured for storage of an operational portion of a set of computer equipment.

Figure 3:
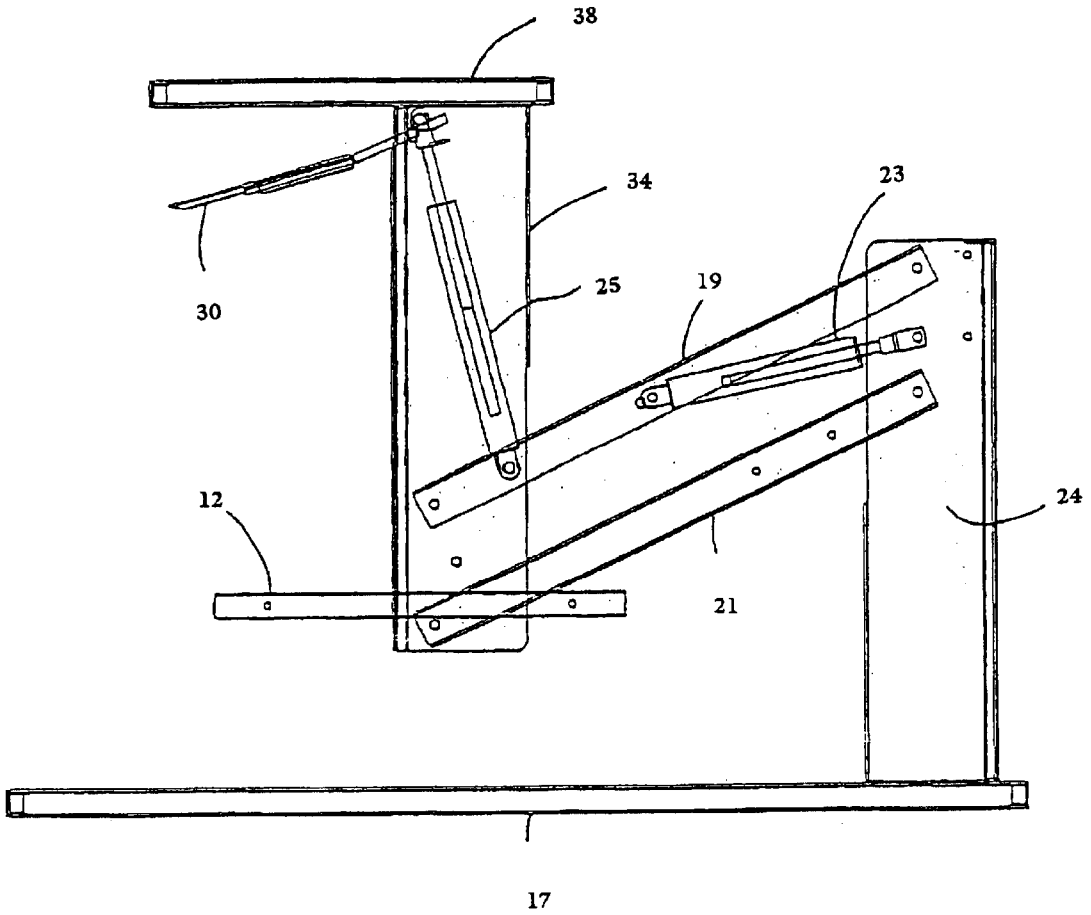
FIG. 3 is an elevational side view in partial cross section of the embodiments depicted in FIG. 1 and FIG. 2.

Coupled at the upper end of each of the first and second vertical support 14, 16 are a pair of height adjustment actuators 30, 32 which preferably comprise paddle-shaped levers pivotably coupled to powered biasing forces, such as locking gas springs 25, which are positioned inside upper static supports 34, 36 and are best seen in FIG. 3. The opposite end of gas spring 25 is pivotably attached to first arm 19 of linkage 18. Locking gas springs 25 serve to start the desktop 12 in motion when the user depresses actuators 30, 32, thereby unlocking gas springs 25. When either actuator 30 or 32 is released, gas springs 25 lock and stop desktop 12 at its current position. Desktop 12 is locked into this position until a user depresses actuators 30, 32 to reposition the desktop.

Height adjustment actuators 30, 32 are each manually engaged by depressing each actuator 30, 32 toward a protective lever guard member 38, 40 which also provides manual leverage during adjustment by an operator. Over the entire range of adjustable motion of the working area 12, the height adjustment actuators 30, 32 are preferably disposed above said working area 12 at a constant height relative to the working area 12.

In an embodiment utilizing a powered biasing force 25, each actuator 30, 32 comprises a mechanical lever which is coupled to the powered biasing force 25 so that power is provided to the biasing force 25 on each of the vertical supports 14, 16 at the same time so that the working area 12 remains essentially in the same orientation (e.g., parallel or tilted) with respect to the surface on which the desktop 10 is positioned as the vertical height of working area 12 is adjusted. The powered biasing force may be provided by a gas spring, a stepper motor, a servo motor, or any type of linear actuator (including switches and a source of power if non-manual) including a leadscrew, a spring, a telescoping member, and the like. Furthermore, if a powered biasing force is used, preferably a limit, or stop, switch should be configured so that no damage occurs to the improved desktop due to an overextended amount of travel.

The working area 12 may be provided with a supporting frame member 42 to increase the rigidity and strength of the working area 12. Such a support frame member 42 may take many forms such as one or more members spanning all or a portion of the underside of the working area 12, an enclosed frame (as depicted in FIG. 1 and FIG. 2), of a combination of both types of frames. In addition, while not depicted, the frame may be disposed on the upper portion of the working area 12 in which case the frame member 42 may also provide a raised edge, or lip feature, around most of the periphery of the working area 12. In a related embodiment, a functional equivalent of such a support frame member 42 may be incorporated into the working area 12, such as positioned intermediate two outer layers forming the working area 12, or disposed in an interior portion or cavity of said working area 12.

In addition to a powered biasing force, such as locking gas springs 25 positioned in each upper static support 34 and 36, additional units of biasing force may be provided to increase the lifting strength of desktop 10. In the embodiment shown in FIG. 3, supplemental biasing force 23 is positioned on first arm 19 of linkage 18 and is attached to static lower portion 24. In this embodiment, biasing force 23 is preferably a gas spring providing constant pressure and increasing the overall lifting strength of the desktop 10. The lifting strength of the supplemental biasing force is preferably commensurate with the desktop load.

The working area 12 can be lowered until upper static supports 34, 36 reach and touch elongate foot portions 17, and can be raised until the biasing force 25 has reached its full extension. In the depicted embodiment, the preferred range of vertical adjustment of the working area 12 relative to the floor supporting the desktop 10 is from about six to about thirty-one inches (6" to 31") so that the working area 12 may be fixed at any set height therebetween. One particular advantage of the desktop 10 of the present invention is the ability to adjust the height to less than about 20 inches above the surface on which the desktop 10 is positioned.

The lifting capacity of the desktop 10 is proportional to the weight loaded onto the working area 12. If the weight loaded onto the working area 12 is less than about thirty pounds, almost no effort is required to raise or lower the working area 12. If the weight loaded onto the working area 12 is about thirty to fifty pounds, only moderate manual assistance is required to raise or lower the working area 12. If the weight loaded onto the working area 12 is greater than fifty pounds (but less than about eighty-five pounds, the structural maximum weight of the depicted embodiment), requires moderate manual effort to raise or lower the working area 12. The use of supplemental biasing forces 23, as shown in FIG. 3, can minimize or even substantially eliminate the manual effort required to adjust loads up to about 85 pounds.

The preferred materials for the desktop 10 include use of cold-rolled steel finished with a layer of corrosion resistant powder coating for the vertical supports 14, 16 and the first and second brace members 20, 22 as well as the tabletop frame 42. The working area 12 is preferably fabricated from three-quarter inch (¾") thick particleboard having a scratch and stain resistant laminate sheeting covering at least the upper portion of the working area 12. Of course, a wide variety of materials may be used in lieu of the preferred particleboard, such as different thickness particle board, wood, metal or metal-alloy sheeting, ceramic material, resin or plastic material, composite material, tempered glass and the like. One advantage of using particleboard is that particleboard is relatively inexpensive and rigid and fastening components to particleboard is relatively simple and well known in the furniture industry.

The working area 12 may be of any desired shape, such as, but not limited to, rectangular, square, oval, round, kidney-shaped and the like. The working area 12 may also include any additional features found in desktops such as being split-leveled, fully or partially tiltable, and the like.

When the improved desktop 10 of the present invention is used for supporting a desktop style computer terminal or workstation, including the central processing unit (CPU) thereof, an optional CPU stand may be coupled to either vertical support member 14, 16 or other convenient structurally sound location so the CPU stand is spaced from the floor surface (and can be moved with and maintaining the mobility of the desktop 10). The CPU stand preferably is connected to the foot portion 17 with a cantilever-type mechanical fitting having vertical portions to retain a CPU for a computer terminal or workstation without reducing access to operable controls and input/output ports of said CPU.

The actuators 30, 32 may be formed of any relatively rigid material including metal, plastic or resin and the like. The actuators preferably comprise a mechanical linkage which provides a travel stop at each end of the range of adjustable motion for the working area 12 The actuators 30, 32 are preferably readily accessible to the user (or an assistant of the user) of the desktop 10 from the usual work location, or station, occupied by the user when working at and/or adjusting the elevation of the working area 12. The actuators 30, 32 preferably must be simultaneously depressed in order to lift and lower the working area 12. When either actuator 30, 32 is released the working area 12 will cease to move and locks into the then-present position. Likewise, the working area 12 cannot begin to lift or lower unless or until both actuators 30, 32 are depressed. The requirement of having both actuators 30, 32 depressed simultaneously adds to the safety of the operation of the improved desktop 10. Although actuated biasing forces, such as gas springs 25, have been shown and described herein, other mechanisms for lifting and lowering the desktop 10 are contemplated by the present invention. Such mechanisms include, but are not limited to, other fluid-containing springs, motors, screws and the like. Furthermore, the embodiments contained herein describe a manual actuation of the biasing forces in the upper static supports 34, 36, but the actuation may be computer-controlled so that the desired position of working area 12 can be programmed and automatically adjusted based on, for example, different user heights, different work types, and the like.

The desktop 10 of the present invention advantageously utilizes identical vertical supports 14, 16 having pre-drilled and pre-configured mounting locations for the working area 21 and the first and second brace members 20, 22. Preferably the vertical supports 14, 16 are essentially identical in configuration and are preferably assembled prior to packing and shipping the desktop 10 to a user. Thus, the packaging for the desktop 10 is compact and readily shipped at standard shipping rates by weight.

To assemble the desktop 10 of the present invention requires merely that the user couple the working area 12 and the first and second brace members 20, 22 to the first and second vertical support. Optionally, and as mentioned above, caster wheels and the like may be added to the foot members 17, a CPU stand may be coupled to the foot member 17, and additional biasing force 23 may be added (via a pair of supplemental gas springs). The lifting capacity of the pair of supplemental gas springs 23 is proportional to the desired weight resting on the desktop 10. The lifting and lowering efforts can be largely counterbalanced up to a load of 85 lbs. to increase the mechanical advantage provided by the desktop 10. The additional biasing force 23 may be added by the user (or ordered in advance and fitted by the manufacturer) to the desktop 10. The resulting assembly is ready for immediate use.

The appended claims define the claimed invention, although those of skill in the art to which the present invention is directed will appreciate that the techniques, processes and equipment according to the present invention may be insubstantially modified without departing from the spirit and scope of the present invention as defined by the following claims. A primary thrust of the design of the present invention is to create an improved desktop which can be adjusted to lower heights.

I claim:

1. An improved desktop, comprising:

a working area having opposing first and second end portions;

a first vertical support member having a first vertically adjustable portion pivotably coupled to said first end portion of said working area;

a second vertical support member having a second vertically adjustable portion pivotably coupled to said second end portion of said working area; and a first manual actuator and a second manual actuator coupled to said first vertical support and said second vertical support, respectively;

wherein said first and said second manual actuator are each disposed above both the working area and the first and the second vertically adjustable portions of said first and second vertical support member so that when said first and said second manual actuator is manually engaged, the working area may be manipulated to a different elevation relative to an initial elevation.

2. The desktop according to claim 1, wherein the first and second vertical support members further comprise first and second lower stationary portions, respectively, and the working area may be manipulated to an elevation that is less than a height of said first or second stationary portions.

3. The desktop according to claim 2, wherein the first and second vertically adjustable portions and the first and second lower stationary portions are connected by at least two elongate arms, each arm having one end pivotably connected to one vertically adjustable portion, and an opposite end pivotably connected to one stationary portion.

4.An improve desktop according to claim 3, wherein said working area may be manipulated from an initial elevation of approximately six inches to a different elevation of approximately thirty-one inches from a supporting surface for said improved desktop.

5. The desktop according to claim 2, wherein:

the first and second vertical support member each include an elongate base member coupled to the lower stationary portion, extending beyond the front portion of the working area and configured to support the improved desktop in an upright position relative to the supporting surface; and said desktop can be positioned to touch said elongate base members.

6. An improved desktop according to claim 1, wherein said working area has a front portion which extends toward an operator station and said first and said second manual actuator extend toward said operator station so that they are readily manually actuated by an operator situated at said operator station.

7. An improved desktop according to claim 1, wherein said first vertical adjustable portion and said second vertical adjustable portion are substantially identical to each other.

8. The desktop according to claim 1, wherein the first and second manual actuators are each coupled to a biasing force capable of changing the elevation of the desktop when the actuators are engaged by a user.

9. An improved desktop, comprising:

a working area having opposing first and second end portions;

an elongate first vertical support member having a vertically adjustable portion pivotably coupled to said first end portion of said working area;

an elongate second vertical support member having a vertically adjustable portion pivotably coupled to said second end portion of said working area; and a first and second manual actuator coupled to said first vertical support and said second vertical support, respectively;

wherein said first and said second manual actuator is disposed extending toward and above said working area so that the first and second manual actuator is readily available to a user of said improved desktop and is at all times disposed above the vertically adjustable portions of said first and second vertical support member, and the elevation of the working area may be changed from an initial position to a different position when the first and second manual actuator are both manually engaged.

10. An improved desktop according to claim 9, wherein said vertically adjustable portion is a linear actuator electrically coupled to the first and the second manual actuator.

11. An improved desktop according to claim 10, wherein said linear actuator is a leadscrew coupled to a rotary motor and further comprising an electronic limit switch set to stop the motion of the leadscrew beyond a preselected range of motion of said leadscrew.

12. An improved desktop according to claim 11, wherein said working area is at an orientation substantially parallel to or at an angle relative to a surface on which the desktop is positioned.

13. An improved desktop according to claim 12, wherein the orientation of the working area can remain substantially the same at the initial position and the different position.

14. A method of operating an improved desktop while stationed in a working position in front of a working area of said desktop, comprising the steps of:

providing a work area having a first actuator associated with a first vertically adjustable vertical support member and a second actuator associated with a second vertically adjustable vertical support member, both actuators being disposed above a plane defined by the working area;

manually engaging both actuators above the plane defined by a working area;

changing the elevation of said working area from above the working area; and, releasing said first actuator or said second actuator thereby seizing said working area at a discrete elevation.

15. A method of operating an improved desktop, according to claim 14, further comprising the step of first locking a mechanism for moving said improved desktop across a floor surface.

16. A method of fabricating an improved desktop, comprising the steps of:

supporting a first elongate vertical support assembly in a vertical orientation, wherein said first vertical support has a vertical height actuator disposed at an upper static end and a vertically adjustable portion disposed intermediate the upper static end and a lower static end;

supporting a second elongate vertical support assembly in a vertical orientation, wherein said second vertical support has a vertical height actuator disposed at the upper static end and a vertically adjustable portion disposed intermediate the upper static end and the lower static end;

mechanically coupling a first side of a major planar working area to the upper static end of the first vertical support;

mechanically coupling a second side of the major planar working area to the upper static end of the second vertical support; and wherein said vertical height actuator of the first and the second elongate vertical support is at all times disposed above said major planar working area.

17. The method of fabricating an improved desktop according to claim 16, wherein the steps of mechanically coupling are performed using at least one selected from the group comprising: a threaded shank and a threaded bolt pair, a threaded screw, a nail, a peg and a blind hole pair, a pre-bored aperture and a cotter- or clevis-type pin connected to an elongate shank, a portion of solder, a weld, an adhesive material, a rivet, or a combination rivet and threaded nut.

18. The method of fabricating an improved desktop according to claim 16, further comprising the step of mechanically coupling a set of wheels to the lower static end of said first and said second elongate vertical support assembly.

19. An improved desktop, comprising:

a working area having an end portion;

a vertical support member having a first vertically adjustable portion pivotably coupled to said end portion of said working area; and a manual actuator coupled to said vertical support;

wherein said manual actuator is disposed above both the working area and the vertically adjustable portion of said vertical support member so that when said manual actuator is manually engaged, the working area may be manipulated to a different elevation relative to an initial elevation.

20. An improved desktop, comprising:

a working area;

a vertical support member having a first vertically adjustable portion coupled to said working area; and an actuator coupled to said vertical support;

wherein said manual actuator is disposed above the working area so that when said manual actuator is engaged, the working area may be manipulated to a different elevation relative to an initial elevation.

21. The apparatus of claim 20, wherein the working area is adjustable to a position less than 20 inches from a surface whereon the apparatus rests.

* * * * *